US005626323A

United States Patent [19]

Lechman et al.

[11] Patent Number: 5,626,323

[45] Date of Patent: May 6, 1997

[54] ADJUSTABLE KEYBOARD HOLDER

[75] Inventors: John N. Lechman, Effingham; Anne T. Risse, Oak Lawn, both of Ill.

[73] Assignee: Nova Solutions, Inc., Effingham, Ill.

[21] Appl. No.: 454,646

[22] Filed: May 31, 1995

[51] Int. Cl.[6] ..... A47B 83/00

[52] U.S. Cl. ..... 248/286.1; 108/50; 108/137; 108/138; 248/918; 248/291.1

[58] Field of Search ..... 108/143, 137, 108/50, 138; 248/918, 286.1, 291.1

[56] References Cited

U.S. PATENT DOCUMENTS

| | | | |
|---|---|---|---|
| 4,194,452 | 3/1980 | Crowther et al. | 108/138 |
| 4,717,112 | 1/1988 | Pirkle | 108/143 X |
| 5,118,172 | 6/1992 | Ugalde | 108/143 X |
| 5,292,097 | 3/1994 | Russell | 248/918 X |
| 5,302,015 | 4/1994 | Du Vall | 248/286 X |
| 5,490,466 | 2/1996 | Diffrient | 108/138 X |

*Primary Examiner*—Carl D. Friedman
*Assistant Examiner*—W. Glenn Edwards
*Attorney, Agent, or Firm*—Olson & Hierl, Ltd.

[57] ABSTRACT

An adjustable keyboard holder has a keyboard support. Relative to a horizontal work platform, the keyboard support is slidably extensible from a storage position to a working position and is retractable therefrom. In the working position, the keyboard support is vertically adjustable and tilt angle adjustable. The keyboard support is pivotably supported on each end by two pairs of lever arms and these lever arms are all pivotably supported by a pair of slidable beams so that a parallelogram arrangement is achieved which is used for keyboard support vertical positioning. One pair of lever arms is slidably movable relative to the associated respective beams so that, by varying the distance between lever arm pivot locations along each beam, tilt positioning is accomplished. Adjustable friction enhancers permit position fixing of the lever arms when the keyboard support is in a desired attitude. The keyboard support can be a keyboard tray or a combination of a keyboard with interconnection means for lever arm association.

15 Claims, 4 Drawing Sheets

ADJUSTABLE KEYBOARD HOLDER

FIELD OF THE INVENTION

This invention relates to adjustable keyboard holders that are particularly well adapted for use with a monitor underdesk structure or the like.

BACKGROUND OF THE INVENTION

Various adjustable keyboard holders are known which can be slidably extended and retracted from a storage location under a (typically) horizontal working platform to a working location adjacent to the working platform, and which can be vertically and tiltably adjusted by the user when in the working location; see, for example, Bartok U.S. Pat. No. 4,923,259, Hatcher U.S. Pat. No. 5,037,163 and Drabczyk et al. U.S. Pat. No. 5,294,087.

Each of these prior art keyboard holders is characterized by having many individual subelements, a plurality of which are movable in the assembled and operative structure. These holders are thus relatively complex, costly to manufacture, subject to mechanical problems and may have a relatively limited use life.

A keyboard holder may be adapted for use in a work station that is also equipped with a monitor support that is itself adapted to support an inclined monitor beneath a central portion of the station's working platform. Such a keyboard holder preferably does not interfere with user viewability of the monitor through a centrally located transparent portion in the working platform. Also, and depending upon the particular arrangement of components in the work station, such a keyboard holder may not interfere with monitor viewability even when the keyboard holder is in its storage location.

All known prior art keyboard holders require a keyboard support tray upon which a keyboard rests. In certain applications, as when the monitor is supported under a working platform viewing window, this keyboard support tray itself can interfere with monitor viewability through the viewing window, depending upon the positioning of the components.

There is a need for an improved, reliable, safe, low maintenance, simplified, adjustable keyboard holder which is compatible with an underdesk supported monitor that is viewable through a work station's working platform window. The present invention supplies this need.

SUMMARY OF THE INVENTION

This invention relates to a new and very useful improved adjustable keyboard holder that is simple to make and use.

The adjustable keyboard holder is also reliable and safe, and requires little or no maintenance.

The adjustable keyboard holder is non-interfering with an inclined monitor that is supported under an associated working platform and that is viewable through a transparent portion in the working platform.

In one aspect, the invention relates particularly to an adjustable support mechanism for a keyboard tray, keyboard, or the like. The mechanism is horizontally transversely slidably movable in a manner comparable to a desk drawer, yet provides for adjustable user-selected height positioning and for adjustable user-selected keyboard tilt positioning about a horizontal axis.

In another aspect, the invention relates particularly to interconnection means, and to a combination of interconnection means with an adjustable support mechanism, for directly associating each respective opposite end of a keyboard with an adjacent outer functional terminal region of an adjustable support mechanism such as the adjustable support mechanism of the present invention.

The adjustable support mechanism of this invention incorporates two pairs of spaced, parallel lever arms that pivot at each lever arm end about respective horizontal axes. The individual lever arm members of each lever arm pair are located along a different opposite end of a keyboard tray or keyboard in laterally spaced, parallel relationship to each other. The respective lever arm members of one pair are each transversely spaced from the lever arm members of the other pair, and the lever arm members of each pair have generally common horizontal axes.

One end of each lever arm member of each pair is associated pivotably with a different one of a pair of transversely slidable support beams. The beams are in laterally spaced, parallel relationship to each other. Each beam is transversely slidable from a storage location under a work platform to an extended or use location. The opposite end of each lever arm member of each pair is associated pivotably with an adjacent portion of a keyboard tray or a keyboard interconnection means.

For height adjustment when the beams are extended and a keyboard or keyboard tray is pivotably associated therebetween by the lever arms, a classic parallelogram type of lever arm arrangement is thus provided by which a desired height adjustment of keyboard or keyboard tray is achievable by pivotably moving the lever arms. Adjustable friction enhancer means associated with each beam and with each one of the forward lever arm pair members permits tightening and retention of the keyboard or keyboard tray at a desired, selected height.

For tilt adjustment when the beams are extended, the rearward lever arm pair members are each slidably movable along, but remain pivotably connected to, each respective adjacent associated beam. Varying the distance between the spatially fixed but pivotable forward lever arm pairs by slidably moving the rearward lever arm pairs varies the tilt of the keyboard or keyboard tray. Adjustable friction enhancer means associated with each beam and with each of the rearward lever arm pair members permits tightening of the rearward lever arm pair members relative to their adjacent respective beams, thereby retaining the associated keyboard or keyboard tray at a desired inclination angle.

The interconnection means of this invention for achieving direct keyboard association with an adjustable support mechanism permits one in a preferred embodiment of this invention to eliminate a keyboard tray from an adjustable keyboard holder. Thereby, interference problems are avoided particularly of the type that can be caused by the presence of a keyboard tray with regard to the viewability of the screen of an angularly inclined monitor that is situated under the working platform for viewability through a windowed aperture in a working platform. Also, the cost of a keyboard tray can be avoided. Further, problems with utilizing keyboards that do not fit individual keyboard trays are eliminated.

As indicated, the keyboard adjustment apparatus provided by this invention is relatively simple. It is easy to fabricate and operate. Also, it is very reliable requiring little or no maintenance. Since independent adjustment knob means are provided on each lateral side, the apparatus is believed to be more stable and safe to use than apparatus of the type where only a single actuator means is provided for achieving adjustment of vertical position and/or tilt position.

In one preferred mode of practicing this invention, the knob means used for initiating or terminating vertical height and tilt angle adjustment are characterized by diameters sufficiently small to be non-interfering with the internal height of the vertically spaced flanges of the stationary supporting rails employed for guiding sliding movements of the beams. Thus, these knobs are receivable between these flanges when the beams are retracted.

In the presently preferred embodiment of the invention, where the adjustable support mechanism is in coacting combination with the keyboard interconnection means, a new improved and highly efficient type of adjustable keyboard holder assembly is provided.

Other and further objects, aims, features, purposes, advantages, embodiments, alternatives and the like will be apparent to those skilled in the art from the accompanying specification and appended drawings.

DETAILED DESCRIPTION

Figure 1:
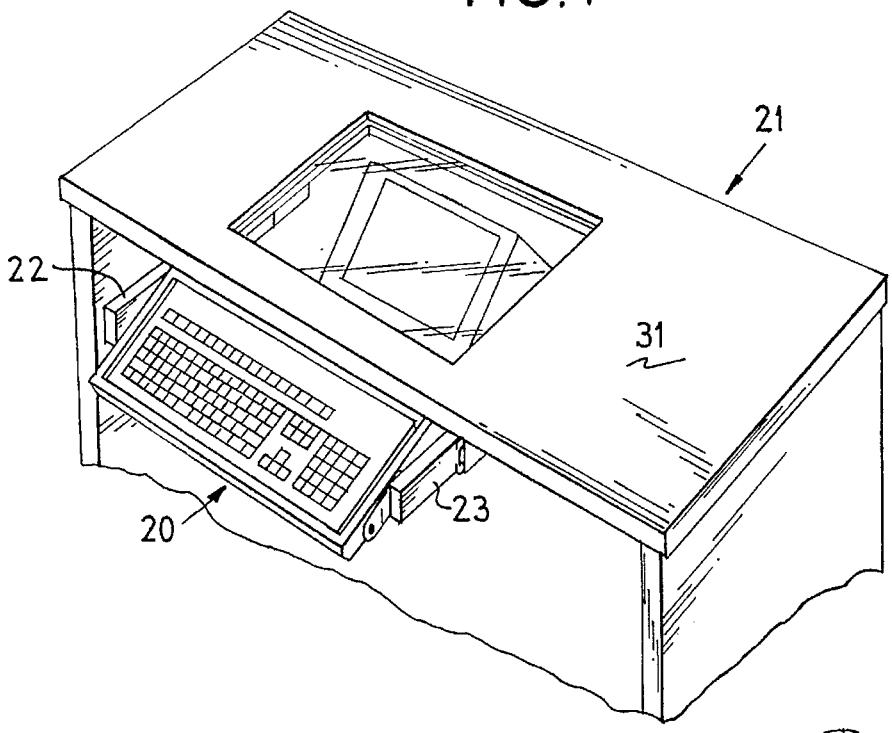
FIG. 1 is an environmental perspective view of one embodiment of an adjustable keyboard holder of the present invention.
Figure 2:
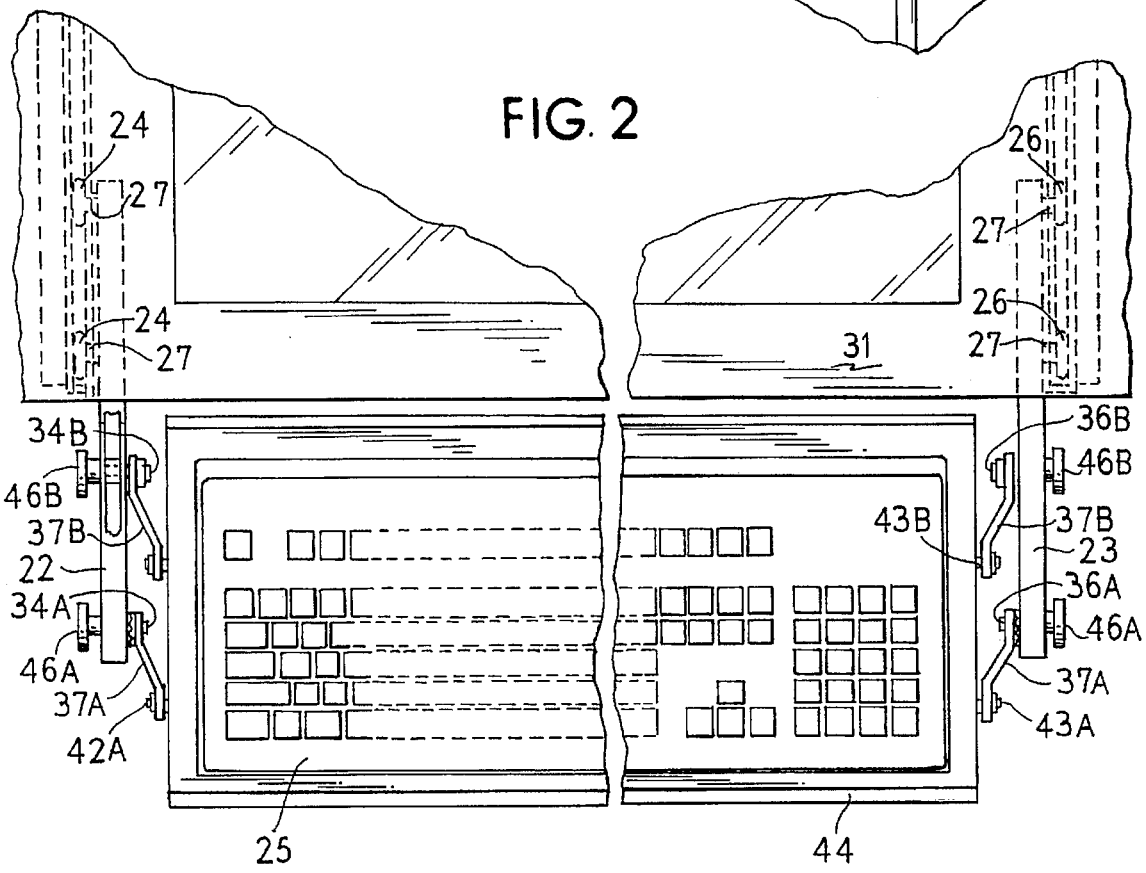
FIG. 2 is a fragmentary top plan view of the adjustable keyboard holder of FIG. 1 with the holder in its horizontally and transversely extended position and with the keyboard tray in a horizontal orientation.
Figure 3:
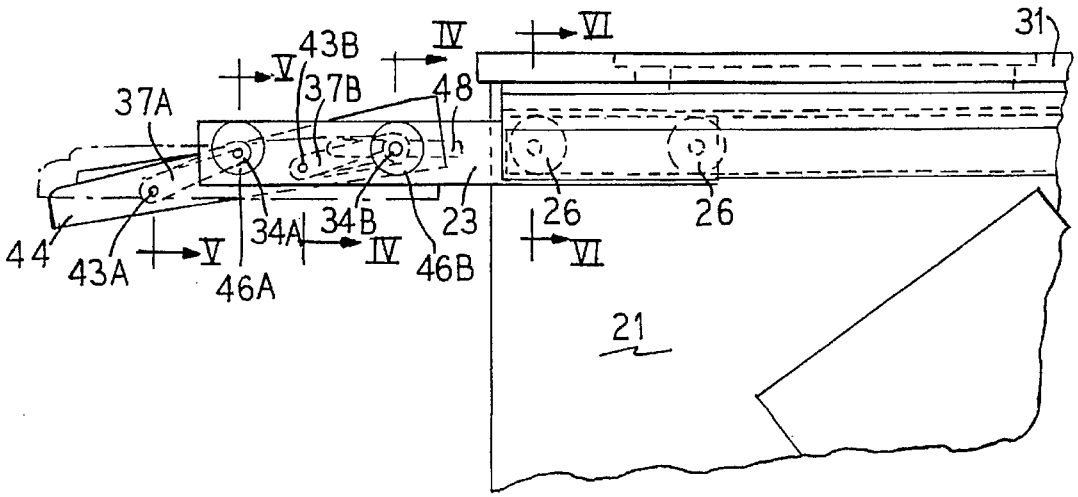
FIG. 3 is a fragmentary side elevational view of the adjustable keyboard holder of FIG. 2 showing the keyboard tray tilted and also showing the horizontal position of the keyboard tray in phantom.

Referring to FIGS. 1–7, there is seen one embodiment 20 of a keyboard holder of this invention. Holder 20 incorporates a pair of longitudinally spaced (relative to an associated monitor underdesk structure such as an illustrative desk-type work station structure 21) beams 22 and 23. Each respective beam 22 and 23 is elongated and is associated adjacent its rear end region with a pair of out-turned conventional rollers 24 (on beam 22) and 26 (on arm 23), respectively. Conveniently, each beam 22 and 23 is comprised of a metal tube comprised of steel or the like having a rectangular cross-section, or otherwise as desired. Each roller of each pair is longitudinally (relative to its associated beam) spaced relative to the other. Each one of the rollers 24 and 26 is revolvable on an associated stub shaft 27 that extends perpendicularly (relative to each beam) on the outside of each beam 22 and 23. Each pair of rollers 24 and 26 is transversely (relative to station structure 21) moveable along and between the upper and lower vertically spaced flanges of a stationary conventional guidance rail or track 28 and 29, respectively.

Each track 28 and 29 is here elongated and is in spaced, parallel relationship relative to the other. Each track 28 and 29 is here identical to the other, but track 27 is turned 180° relative to the other track 29, and each track 28 and 29 is mounted to the under side of the top or working platform 31 of the desk structure 21 by means of welded brackets 32 (see FIGS. 3–6) using screws 33 or the like. Thus, each beam 22 and 23 is transversely slidably extensible and retractable along and relative to its respective associated track 28 and 29 from a storage position located under platform 31 to an extended outer position located (see FIG. 3, for example) in adjacent, spaced relationship to a front longitudinal edge region of the platform 31.

The forward end region of each beam 22 and 23 is provided with a pair of transversely spaced pivot pins 34 (on beam 22) and 36 (on beam 23), respectively. The pins or shafts 34 and 36 extend perpendicularly through apertures in their respective arms 22 and 23.

A keyboard support tray 44 is provided which preferably and conveniently has rounded top side and end edge portions. One end of tray 44 is provided with a transversely spaced pair of pivot pins (or shafts) 42 and the opposite end of tray 44 is provided with another such pair of pivot pins (or shafts) 43 that are each preferably coaxial with the pins 42. Preferably, the pins 42 and 43 extend laterally outwardly and perpendicularly relative to the beams 22 and 23. The tray 44 can be conveniently formed of sheet metal or thermoformed plastic sheeting. The pins 43 and 42 can be conveniently formed of steel and can be conveniently mounted through opposite end wall portions of tray 44.

Four lever arms 37 are provided. Each lever arm 37 has one end 38 thereof offset from the opposite other end 39 thereof by having a mid-region 41 that diagonally extends and functions as an interconnecting linking portion between the end portions 38 and 39. Each lever arm has a hole formed therethrough at each opposite end 38 and 39. The end 38 of one lever arm 37 is pivotably mounted over a different one of each of the pivot pins 34 and 36 of the beams 22 and 23, and the other end 39 of each lever arm 37 is pivotably mounted over an adjacently located, matingly engagable one of the pivot pins 42 and 43 of the keyboard support tray 44.

There are thus in effect two pairs of lever arms. The lever arm members of each pair are in laterally spaced, parallel relationship to each other and are located adjacent a different opposite end of the keyboard tray 44. The respective lever arm members of one lever arm pair are in transversely spaced, parallel relationship to the corresponding respective lever arm members of the second arm pair. A corresponding one end region 38 of each lever arm 37 of each such pair of lever arms is pivotably associated relative to a different one of the beams 22 and 23 about pivot shafts or pins 34 and 36. A corresponding opposite end region 39 of each lever arm 37 of each such pair of lever arms is pivotably associated with a different opposite end of tray 44 on the pivot pins or shafts 42 and 43. Hence, there is provided a forward pair of lever arms 37A and a rearward pair of lever arms 37B relative to said keyboard tray 44.

For convenience, a paired member component which is in a forward location relative to its paired member is sometimes designated herein for convenience by the letter A following its identification number, while the other rearwardly located member of the pair is similarly sometimes designated herein for convenience by the letter B following its identification number.

The diagonal linking portion 41 of each lever arm 37 serves to provide desired and preferred lateral spacing between each of the beams 22 and 23 and the adjacent keyboard tray 44, the tray 44 being effectively suspended therebetween by the lever arms 37. While the members of the forward and rearward pairs of lever arms 37A and 37B can have different sizes, or even different configurations, relative to each other, it is now preferred for all lever arms 37 to be substantially similar in size and configuration for ease in fabrication and in tray 44 adjustment when using holder 20. As will be appreciated from the following description, the length of the lever arms 37 regulates the degree of tilt of tray 44 and the vertical maximum distance through which tray 44 can be moved.

The pivot shafts 34 and 36 preferably mount pivotally the lever arms 37 against the inside opposed respective faces of the beams 22 and 23. Preferably, the outside terminal end (relative to tray 44) of each pivot shaft 34 and 36 terminates in finger-graspable, round headed member or knob 46. Conveniently and preferably, each knob 46 has a threaded central channel which is threadably engaged with the threaded outer end of each pivot shaft 34 and 36.

The inside terminal end (relative to tray 44) of each pivot shaft 34 and 36 is associated with a different lever arm 37. In the holder 20, friction enhancer means is optionally but preferably provided for each pivot shaft 34 and 36 and its associated lever arm 37 relative to the adjacent beam 22 and 23. Thus, rotational manipulation of each knob 46 results in either an increase or decrease (depending upon the direction of knob 46 rotation) in frictional force applied to the associated end 38 of each lever arm 37. After decreasing the friction on the arms 37, tray 44 is position adjustable. After a desired position adjustment, tightening the applied frictional force increases the friction so that further movement of lever arms 37 cannot occur, thereby fixing the spatial orientation of the tray 44.

Conveniently and preferably, each knob 46 is configured for slidable longitudinal movement relative to, within and adjacent to each of the rail members 28 and 29 when the beams 22 and 23 are slidably retracted into, and along their respective associated rail members 28 and 29.

In the holder embodiment 20, the friction enhancement means for regulating tray 44 height adjustment is provided as follows (although various suitable friction enhancement means are known). Each of the transversely outermost or forward lever arms 37A (relative to tray 44) at its end 38 is fixedly associated by welding, adhesive or the like (not shown) with a conventional washer 42 of the type having one face (here oriented to be the outer exposed face) which is radially grooved (see FIGS. 5 and 7). The adjacent inside face of each beam 22 and 23 circumferentially about each forward pin 34A and 36B is associated by welding, adhesive or the like, with a second conventional washer 43 of the type having one face which is preferably similarly radially grooved (and which here is likewise oriented to be the outer exposed face). The forward pins 34A and 36A are each extended through respective beams 22 and 23 and engaged with the end 38 of the lever arm 37 by a weldment 53 or the like. The radially grooved faces of washers 42 and 43 are mutually engagable so that neither is pivotable relative to the other when the radially grooved faces of washers 42 and 43 are clamped together with sufficient force. Thus, when the washers 42 and 43 are so clamped together by turning knob 46 relative to pin 34A or 36A, then each of the lever arms 37 of the forward lever arm pair are spatially fixed in position.

The lever arms 37 are adapted to pivot about their associated pins 34 and 36. Thus, in the holder 20 of FIGS. 1–7, for height (up or down) adjustment, a keyboard supporting tray 44 is pivotably supported at each of its opposite ends by two pairs of transversely spaced lever arms 37A and 37B. Each lever arm 37 is also pivotably associated with an adjacent one of the transversely slidable support beams 22 and 23. Thus, a classic parallelogram arrangement is provided whereby the tray 44 is supported between, and is vertically movable relative to, the beams 22 and 23, when the lever arms 37 are pivoted. To retain the tray 44 in a desired height position, the respective forward lever arms 37A are each associated at beam 22 and 23 with a different respective pivot pin 34A and 36A that is associated with a friction enhancer means. Here, illustratively, and as above explained, the friction enhancer means utilizes interengaging, adjustably engagable, non-rotatable, facially ribbed washers 42 and 43 (above described). Turning the forward knobs 46A adjusts the frictional compressional force between the washers 42 and 43 and sets a selected height for tray 44.

Figure 4:
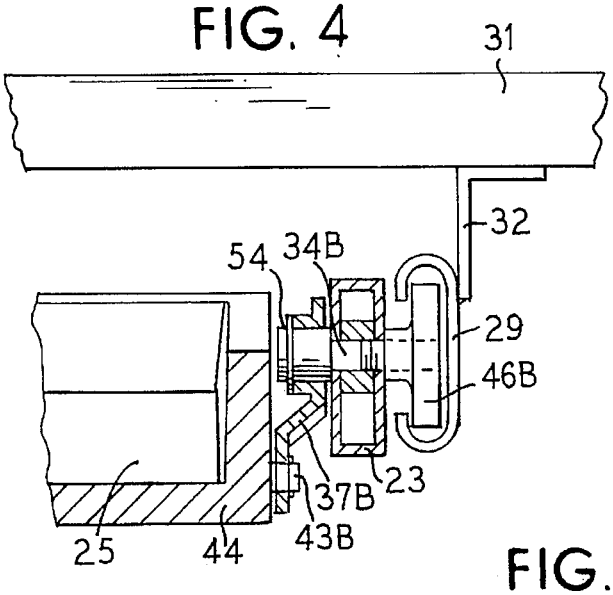
FIG. 4 is a fragmentary vertical longitudinal sectional view taken along the line IV—IV of FIG. 3.
Figure 6:
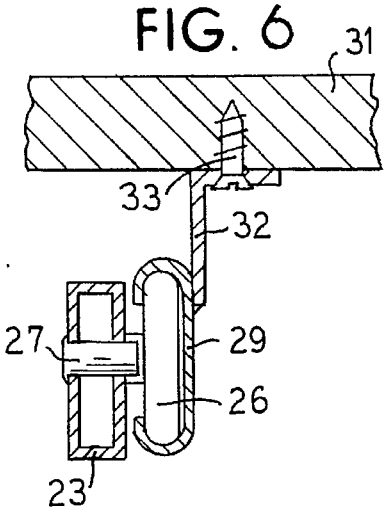
FIG. 6 is a fragmentary vertical longitudinal sectional view taken along the line VI—VI of FIG. 3.
Figure 5:
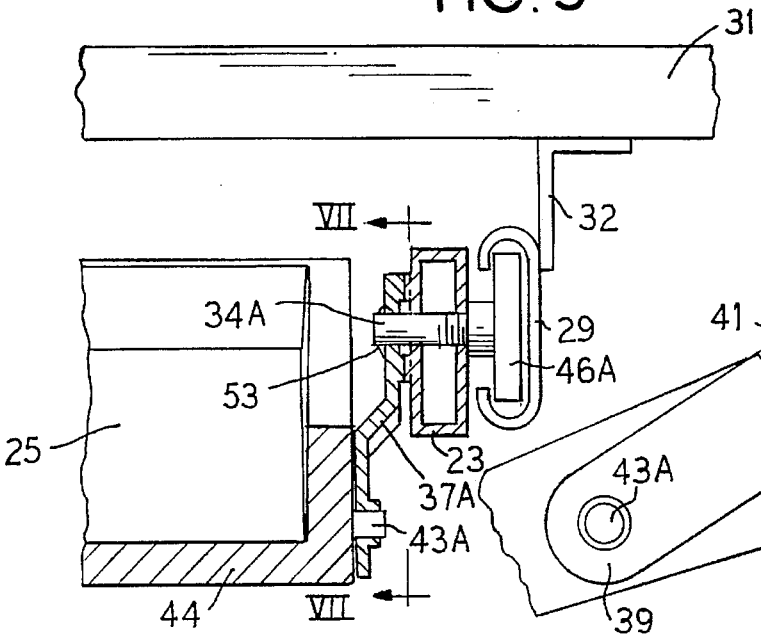
FIG. 5 is a fragmentary vertical longitudinal sectional view taken along the line V—V of FIG. 3.
Figure 7:
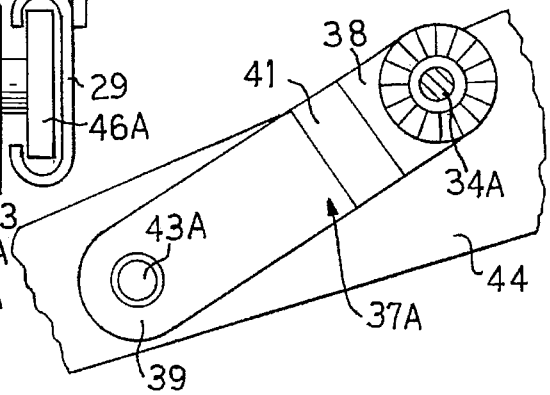
FIG. 7 is a fragmentary vertical transverse sectional view taken along the line VII—VII of FIG. 5.

In an illustrative friction enhancement means in achieving tilt adjustment in the holder 20, the rearward lever arms 37B are each pivotably connected at beams 22 and 23 about rearward pivot pins 34B and 36B, as indicated above (see FIG. 4). Each of the inner (relative to tray 44) end regions of shafts 34A and 36B is radially enlarged into an integrally formed (with each shaft 34B and 36B), generally cylindrically configured retaining head 35. After being extended through its respective associated beam 22 and 23 from the inside outward, the outer threaded end of each shaft 34B and 36B is threadably engaged with its knob 46B.

The end 38 of each rearward lever arm 37B is slipped over the outer cylindrical surface of each head 35 and is retained in a pivotally slidable engagement therewith by a conventional split ring retainer 54 which is received in a terminal circumferential groove (not detailed) in each head 35. Preferably and as shown, the hole through end 38 is provided with a circumferential flange to increase the pivotable surface area of contact between the outer cylindrical surface of each head 35 and end 38 of each lever arm 37B (see FIG. 4).

Each of the shafts or pins 34B and 36B is slidably horizontally movable in a respective slot 48 that is provided in each beam 22 and 23 through which each shaft 34B and 36B extends. Thus, the distance between rearward pins 34B and 36B in each beam 22 and 23 relative to the forward pins 34A and 34B is variable, yet the lever arms 37 are pivotable. When this distance is changed, the tilt angle of tray 44 relative to a laterally extending horizontal axis (not shown) is changed. The position of each pin 34B and 36B relative to its associated slot 48 is fixable by rotatably adjusting the compression regulating knob 46 of each rearward pin 34B and 36B. Thus, to retain the tray 44 in a desired angular tilt position, the pins 34B and 36B associated with each of the rearward lever arms 37B are clamped relative to the beams 22 and 23 between its head 35 and its knob 46 by turning the rear knobs 46B.

To avoid deformation of the side walls of the beams 22 and 23 in the region of the pins 34B and 36B when the associated knob 46B is tightened on each pin 34B and 36B, a spacer sleeve 40 is inserted into each beam 22 and 23 between beam outer and under side walls before the pins 34B and 36B are each slidably extended therethrough during assembly of holder 20. Various alternative friction enhancer means and arrangements can be used for regulating tilt angle adjustment.

Figure 8:
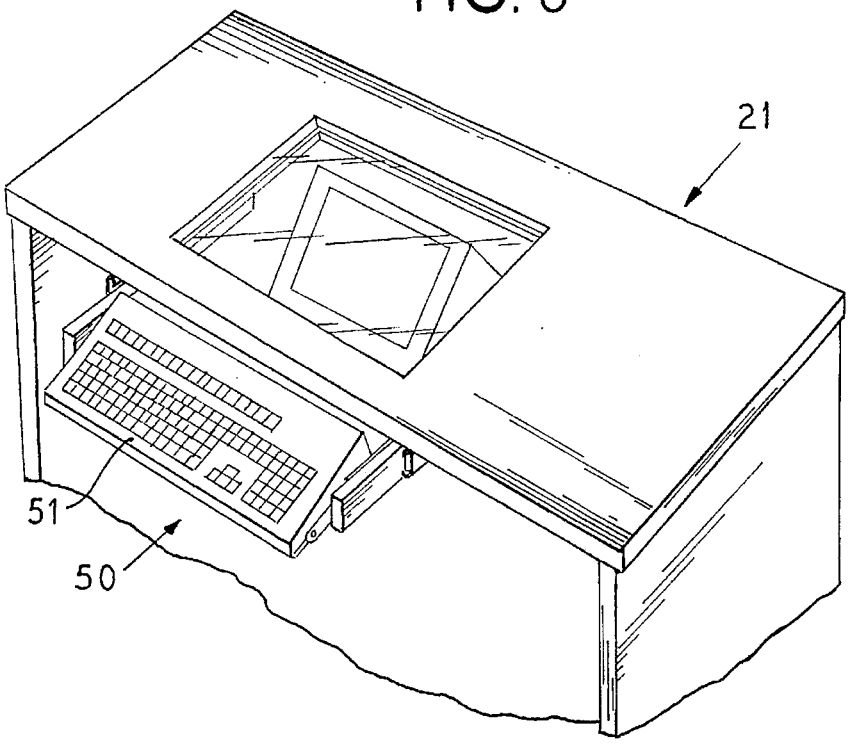
FIG. 8 is a view similar to FIG. 1, but showing an alternative embodiment of an adjustable keyboard holder of the present invention.

Referring to FIGS. 8–16, there is seen another embodiment 50 of a keyboard holder of this invention which is shown in FIG. 8 in association with a work station 21. In holder 50, the position adjustment assembly of the holder embodiment 20 is utilized, and corresponding parts are similarly numbered in holder embodiment 50 but with the addition of prime marks thereto for identification purposes. In holder 50, the tray 44 is eliminated. Instead, a keyboard 51 is supported at each of its opposite ends by one of a pair of interconnecting keyboard support bracket means.

Figure 9:
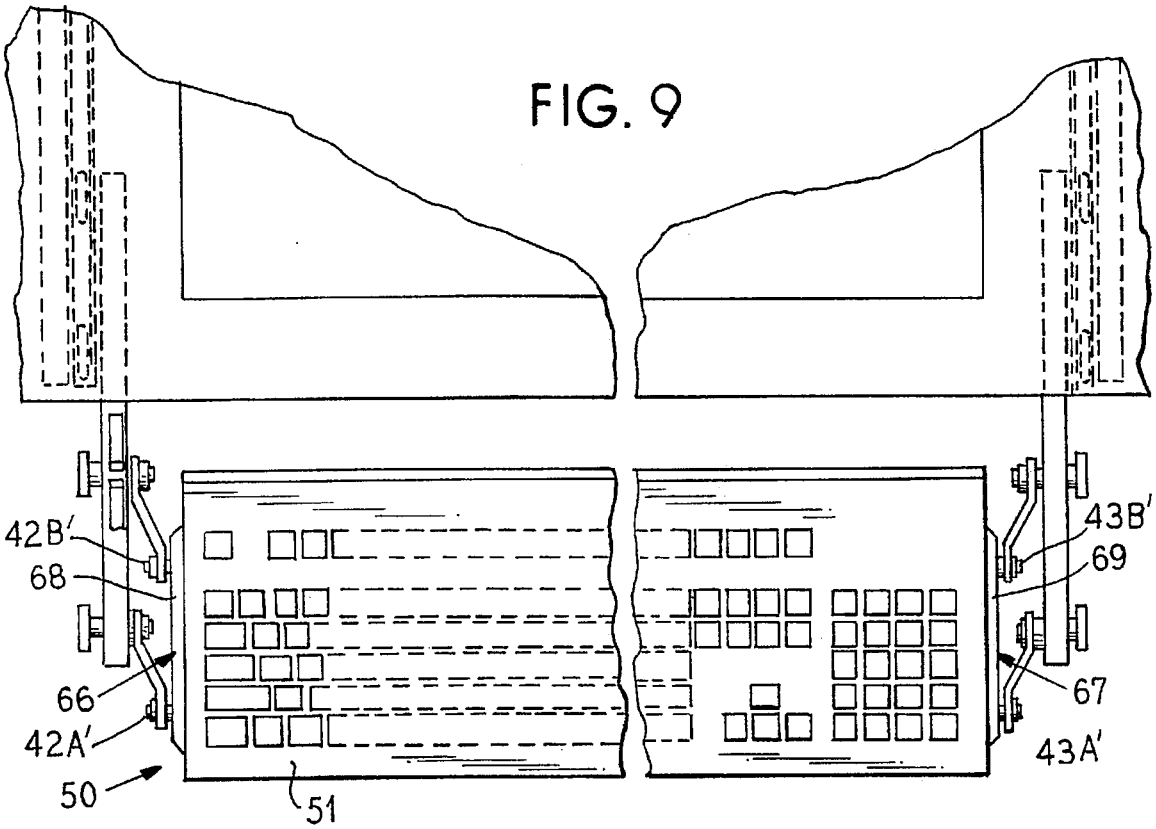
FIG. 9 is a view similar to FIG. 2, but showing the alternative embodiment of FIG. 8 with the holder in its horizontally and transversely extended position and with the keyboard in a horizontal orientation.
Figure 10:
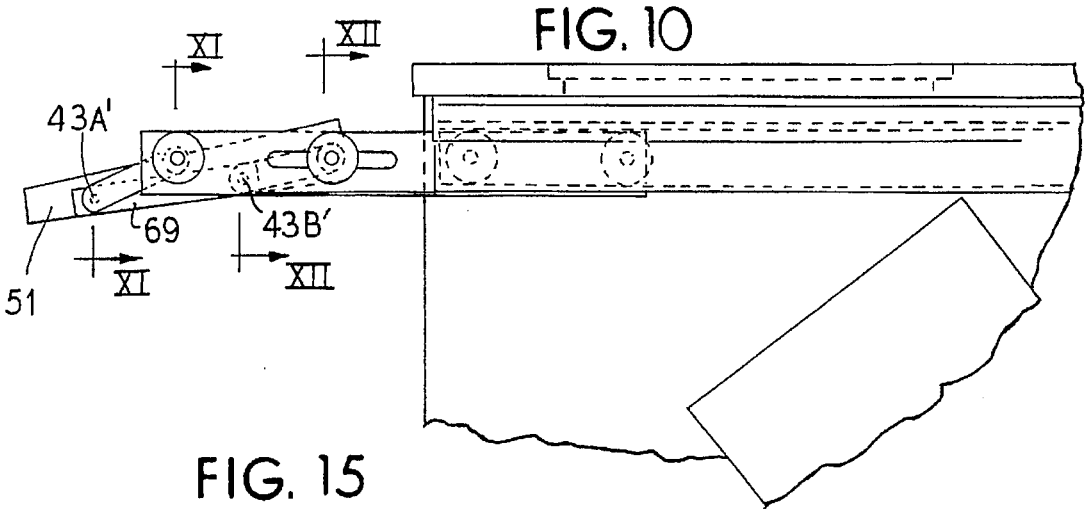
FIG. 10 is a fragmentary side elevational view of the adjustable keyboard holder of FIGS. 8 and 9 with the keyboard tilted and with the horizontal position of the keyboard being shown in phantom.
Figure 11:
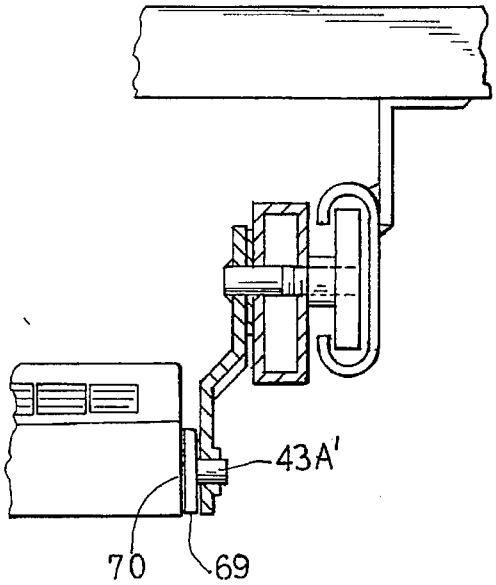
FIG. 11 is a fragmentary vertical longitudinal sectional view taken along the line XI—XI of FIG. 10.

One embodiment of a pair of interconnecting keyboard support bracket means is shown in FIGS. 9, 10 and 11 where the paired bracket means is designated as 66 and 67, respectively.

Each bracket means 66 and 67 characteristically utilizes an elongated flattened plate member 68 and 69, respectively, that is oriented transversely with respect to work station 21. Each plate member 68 and 69 is located along a different opposite end of the keyboard 51. Each plate member 68 and 69 can be comprised of metal or plastic. Each plate member 68 and 69 is associated adjacent its respective opposite ends with different ones of the pivot pins 42' and 43' with screws or the like. Also, the side of each plate member 68 and 69 that is adjacent to an end portion of the keyboard 51 is fixedly associated with such adjacent end of keyboard 51 by means of an adhesive layer 70 (see FIG. 11). Thus, the keyboard 51 is itself directly adjustable by the position adjustment assembly.

Figure 14:
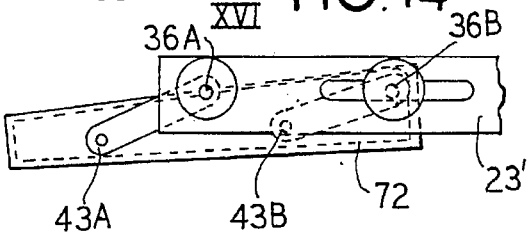
FIG. 14 is a fragmentary side elevational view similar to a portion of FIG. 10, but showing the keyboard holder of FIGS. 8–11 equipped with the keyboard support bracket of FIGS. 12 and 13.
Figure 12:
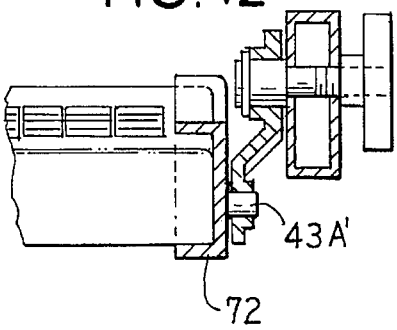
FIG. 12 is a fragmentary vertical longitudinal sectional view taken along the line XII—XII of FIG. 10, but showing an alternative means for mounting the keyboard support bracket to the adjacent keyboard end.
Figure 13:
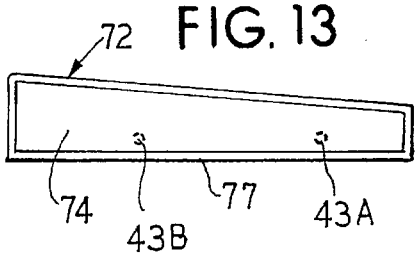
FIG. 13 is a side elevational view of the inside of the cup-like keyboard support bracket utilized in the embodiment of the keyboard support bracket shown in FIG. 12.

Another embodiment of a pair of interconnecting keyboard support bracket means is shown in FIGS. 12, 13 and 14 where the bracket means are individually designated as 72. Only the right hand (relative to a keyboard 51 user) bracket 72 is shown; the left hand bracket is a mirror image of the right hand bracket. Each bracket means 72 is an elongated, cup-like body having a base plate 74 and a peripherally extending, in-turned flange 77.

Each bracket 72 is associated adjacent its respective opposite ends with different ones of the pivot pins 42' and 43'. Each body is configured to slidably extend over a different opposite end of the keyboard 51. Each body 56 can be formed of stamped sheet metal with butt welded spaced projecting steel pivot pins 44, or each body 43 can be formed of injection molded plastic, or the like.

Figure 15:
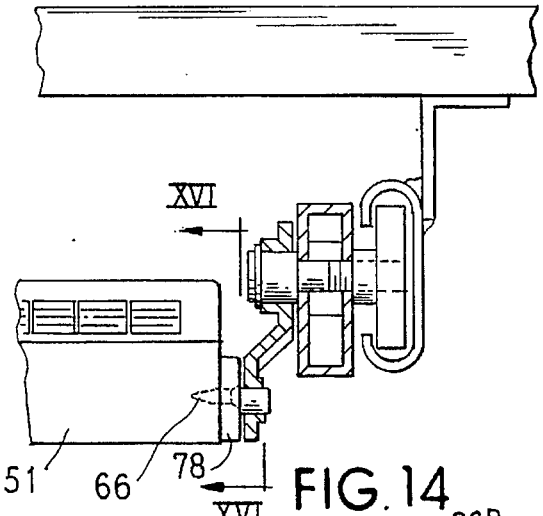
FIG. 15 is a view similar to FIG. 12, but showing an alternative keyboard support bracket for mounting to the adjacent keyboard end.
Figure 16:
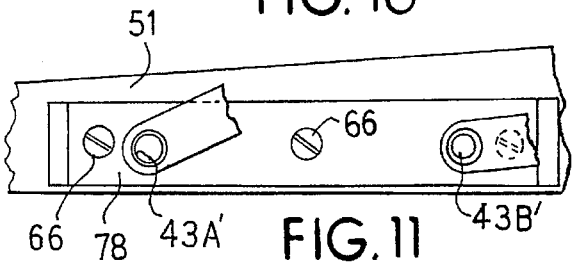
FIG. 16 is a fragmentary side elevational view similar to a portion of FIG. 10, but showing the keyboard holder of FIGS. 8–11 equipped with the keyboard support bracket of FIG. 15.

Still another embodiment of a pair of interconnecting keyboard support bracket means is shown in FIGS. 15 and 16, where each of the two bracket means is designated as 78. The same plate-type bracket 78 is here employed on each end of keyboard 51. Each plate 78 is associated adjacent its opposite ends with different ones of the pivot pins 42' and 43'. Also, in each plate bracket 78, a plurality of apertures are provided through each of which a preferably flat-headed, counter-sinkable screw 66 is extended into threaded engagement with a mating receiving hole (not shown) that is provided in each opposite end of keyboard 40, as shown illustratively in FIG. 16.

Each of holders 20 and 50 does not interfere with the viewability of a monitor 80 that is angularly supported beneath platform 31 for viewability by a user of work station 21 while using a keyboard 51 or a keyboard 25 that is supported by tray 44.

Various other and further embodiments, applications, structures and the like will be apparent to those skilled in the art from the teachings herein provided and no undue limitations are to be drawn therefrom.

What is claimed is:

1. An adjustable keyboard holder comprising in combination:

(a) a pair of spaced, parallel, stationary, elongated rail members including upper and lower support surfaces;

(b) a pair of elongated, spaced, parallel beam means having interconnected roller means for associating each one of said beam means with said support surfaces of a different one of said rail members for extension and retraction movements of each said beam means along and relative to each said associated rail member;

(c) keyboard support means having opposite end portions;

(d) two pairs of lever arm members, the lever arm members of each pair being in laterally spaced, parallel relationship to each other and located adjacent a different one of said keyboard support opposite end portions, the respective lever arm members of one said pair being in transversely spaced, parallel relationship to the corresponding respective lever arm members of the second said pair, a corresponding one end region of each lever arm member of each said pair of lever arm members being pivotably associated with a different one of said beam means, including pivot shaft means therefor, and a corresponding opposite end region of each said lever arm member of each said pair of lever arm members being pivotably associated with a different one of said keyboard support opposite end portions, including pivot shaft means therefor, thereby to provide a forward pair of lever arm members and a rearward pair of lever arm members relative to said keyboard support means; and (e) said rearward pair of lever arm members additionally being slidably horizontally movable along each respective so associated said beam means; whereby said keyboard support means is horizontally extensible and retractable, and, when extended, said keyboard support means is height adjustable and tilt angle adjustable.

2. The adjustable keyboard holder of claim 1 wherein adjustable friction enhancer means is functionally associated between said end region of each said lever arm member and said respective so associated said beam means for restricting movement of each of said lever arm members and including adjustment means therefor.

3. The adjustable keyboard holder of claim 1 wherein said keyboard support means comprises a keyboard support tray.

4. The adjustable keyboard holder of claim 1 wherein said keyboard support means comprises in combination a keyboard having opposite end portions and associated interconnection means at said opposite end portions thereof for connecting said keyboard to said forward and said rearward pair of lever arm members.

5. The adjustable keyboard holder of claim 1 wherein each one of said lever arm members of both said lever arm pairs has a diagonally extending mid-region whereby in each said lever arm member said one end region is laterally offset from said opposite end region, thereby achieving a lateral spacing between each of said beam means and said keyboard support opposite end portions.

6. The adjustable keyboard holder of claim 5 wherein each of said lever arm member has a substantially similar size and configuration.

7. The adjustable keyboard holder of claim 2 wherein each said pivot shaft means for said one end region of each said lever arm member extends laterally and perpendicularly through each respective one of said associated beam means, each said lever arm member is adjacent an inside surface of said associated beam means, the outside terminal end of each said pivot shaft means is threaded and is threadably engaged with knob adjustment means, whereby the amount of friction applied to each said one end region is regulatable by rotational manipulation of said knob means.

8. The adjustable keyboard holder of claim 7 wherein each said knob means is configured for slidable longitudinal movement within and along each of said rail members when said beams are so retracted relative to their respective associated rail members.

9. The adjustable keyboard holder of claim 7 wherein said one end region of each one of said lever arm members of said forward pair of lever arms is fixedly associated with a first centrally threaded plate means whose exposed outer face is radially ribbed, and wherein adjacent portions of said inside surface of said associated beam means is fixedly associated with a second centrally apertured plate means whose exposed outer face is radially ribbed, whereby, when said each knob means is tightened relative to its so associated pivot shaft means, said first plate means is engagable with said second plate means to an extend such that said lever arm members are not further pivotable.

10. The adjustable keyboard holder of claim 7 wherein said pivot shaft means that is associated with each one of said rearward pair of lever arm members so extends through the associated said beam means in a horizontal, elongated slot that is defined in each one of said associated said beam means so that each of said rearward pivot shaft means is slidably horizontally movable in said slot, and wherein said inside terminal end of each one of said rearward pivot shaft means is pivotably engaged with a different one of said rearward pair of lever arms whereby, when said knob means is turned relative to each associated said rearward pivot shaft means, frictional engagement of said rearward pivot shaft means relative to said associated said beam means is increased to a level where slidable movement of said rearward pivot shaft means is prevented.

11. An adjustable keyboard holder comprising in combination:

(a) a pair of spaced, parallel, stationary, elongated rail members including upper and lower support surfaces;

(b) a pair of elongated, spaced, parallel beam means having interconnected roller means for associating each one of said beam means with said support surfaces of a different one of said rail members for slidable extension and retraction movements of each said beam means along and relative to each said associated rail member;

(c) a keyboard means having opposite end portions and associated interconnection means at said opposite end portions;

(d) two pairs of lever arm members, the lever arm members of each pair being in laterally spaced, parallel relationship to each other and located adjacent a different one of said keyboard support opposite end portions, the respective lever arm members of one said pair being in transversely spaced, parallel relationship to the corresponding respective lever arm members of the second said pair, a corresponding one end region of each lever arm member of each said pair of lever arm members being pivotably associated with a different one of said beam means, including pivot shaft means therefor, and a corresponding opposite end region of each said lever arm member of each said pair of lever arm members being pivotably associated with a different one of said keyboard interconnection means, including pivot shaft means therefor, thereby to provide a forward pair of lever arm members and a rearward pair of lever arm members relative to said keyboard support means;

(e) said rearward pair of lever arm members additionally being slidably horizontally movable along each respective so associated said beam means; and (f) adjustable friction enhancer means functionally associated between said end region of each said lever arm member and said respective so associated said beam means for restricting movement of each of said lever arm members and including adjustment means therefor; whereby said keyboard support means is horizontally extensible and retractable, and, when extended, said keyboard support means is height adjustable and tilt angle adjustable.

12. The adjustable keyboard holder of claim 11 wherein said interconnection means comprises a pair of plate means, each plate means being connected with said pivot shaft means for said opposite end region of each of the two said lever arm members that are each so associated with one of said beam means including connecting means for so connecting and each said plate means also being connected to a different opposite end portion of said keyboard including fastening means for so connecting.

13. The keyboard holder of claim 12 wherein said fastening means comprises an adhesive.

14. The keyboard holder of claim 12 wherein said fastening means comprises screw means.

15. The keyboard holder of claim 12 wherein said fastening means comprises a peripherally extending cup-like receptacle into which each said keyboard opposite end region is received.

* * * * *